US006326571B1

(12) United States Patent
Kitamura et al.

(10) Patent No.: US 6,326,571 B1
(45) Date of Patent: Dec. 4, 2001

(54) BUTTON SWITCH

(75) Inventors: Toshiyasu Kitamura; Teruo Nanmoku, both of Kanagawa; Kazuhiro Konishi, Shizuoka; Kouichi Yamamoto, Kanagawa, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/696,310

(22) Filed: Oct. 25, 2000

(30) Foreign Application Priority Data

Oct. 26, 1999 (JP) ..... 11-304594

(51) Int. Cl.[7] ..... H01H 13/14

(52) U.S. Cl. ..... 200/520; 200/5 A; 200/512; 200/275

(58) Field of Search ..... 200/520, 512, 200/513, 5 A, 517, 341, 345, 275

(56) References Cited

U.S. PATENT DOCUMENTS 3,808,384 * 4/1974 Boulanger ..... 200/5 A
4,034,176 * 7/1977 Larson ..... 200/159 B
4,163,138 * 7/1979 Harden ..... 200/310
4,194,105 * 3/1980 Hodges ..... 200/159 B
4,527,021 * 7/1985 Morikawa et al. ..... 200/5 A
4,766,271 * 8/1988 Mitsuhashi et al. ..... 200/159 B
4,771,139 * 9/1988 DeSmet ..... 200/5 A
4,814,561 * 3/1989 Kawasaki ..... 200/517
5,536,911 * 7/1996 Madill ..... 200/6 A

FOREIGN PATENT DOCUMENTS 10-40771 * 2/1998 (JP) .

* cited by examiner

*Primary Examiner*—Lincoln Donovan
*Assistant Examiner*—Kyung S. Lee
(74) *Attorney, Agent, or Firm*—Pearne & Gordon LLP

(57) ABSTRACT

A button switch wherein switching operation of contact patterns 14 printed and wired on a printed circuit board 13 is performed by pushing a contact member 12 provided on a lower face of a pushing member of the button switch is constructed in such a manner that the above mentioned contact member 12 comprises a rubber piece, electrically conductive films formed on upper and lower faces of the rubber piece, and metal wires embedded in the rubber piece so as to interconnect the electrically conductive films, the obtained contact member 12 being bonded to the pushing member.

8 Claims, 3 Drawing Sheets

BUTTON SWITCH

BACKGROUND OF THE INVENTION

The present invention relates to a button switch, and more particularly to the button switch in which a rubber piece having a plurality of thin metal wires embedded therein and electrically conductive films applied to both surfaces to constitute a key button contact portion is provided on a lower face of a pushing member of the button switch.

As shown in FIG. 6, a conventional button switch has been composed of a key button 61, a contact portion 62 provided on a lower face of a pushing member of this key button 61, and contact patterns 64 printed and wired on a printed circuit board 63. Usually, the key button 61 is made of silicone rubber 65 or the like as shown in FIG. 7, and an electrically conductive film 66 made of carbon or the like as the contact portion has been bonded to a lower face of the pushing member of the key button made of the silicone rubber 65.

In the conventional key button switch provided with the contact portion employing the carbon contact or so, in case where the printed circuit board etc. acting as a portion to be contacted is free from foreign substances such as dust, oil, or flux of solder, etc. as shown in FIG. 8, normal switching operation can be performed by pushing the pushing member of the key button. However, in case where the foreign substances such as dust, oil, or flux of solder, etc. have been adhered to the portion to be contacted such as the printed circuit board as shown in FIG. 9, the contacts become inconductive, resulting in a problem of defective switching operation of the switch.

SUMMARY OF THE INVENTION

It is an object of the invention to provide a button switch in which such defective operation of the switch due to presence of the foreign substances can be solved and stable conduction of electricity can be obtained.

According to first aspect of the invention, a button switch comprises a key button, and a key button contact portion which includes a rubber piece having a plurality of thin metal wires embedded therein and electrically conductive films applied to both surfaces of the rubber piece, the rubber piece being provided on a lower face of a pushing member of the button switch.

With this structure, the problem of defective switching operation can be solved and stable conduction of electricity can be obtained.

Further, according to second aspect of the invention, a button switch comprises a contact member provided on a lower face of a pushing member of the button switch and adapted to be pushed to conduct switching operation of contact patterns which are print-wired on a printed circuit board, in that the contact member includes a rubber piece, electrically conductive films formed on upper and lower faces of the rubber piece, and metal wires embedded in the rubber piece so as to interconnect the electrically conductive films, the contact member being bonded to the pushing member.

With this structure, the problem of defective switching operation can be solved and stable conduction of electricity can be obtained.

Further, the electrically conductive films may be made of carbon.

With this structure, the problem of defective switching operation can be solved employing the electrically conductive films made of carbon and stable conduction of electricity can be obtained.

Still further, the metal wires may be gold wires.

With this structure, favorable electrical conductivity can be realized, the problem of defective switching operation can be solved, and stable conduction of electricity can be obtained.

Still further, the rubber piece may be made of silicone rubber.

With this structure, molding can be easily conducted, the problem of defective switching operation can be solved, and stable conduction of electricity can be obtained.

DETAILED DESCRIPTION OF THE PREFERRED EMBODIMENTS

Now, a mode for carrying out the invention will be described hereunder referring to FIGS. 1 to 5.

Figure 1:
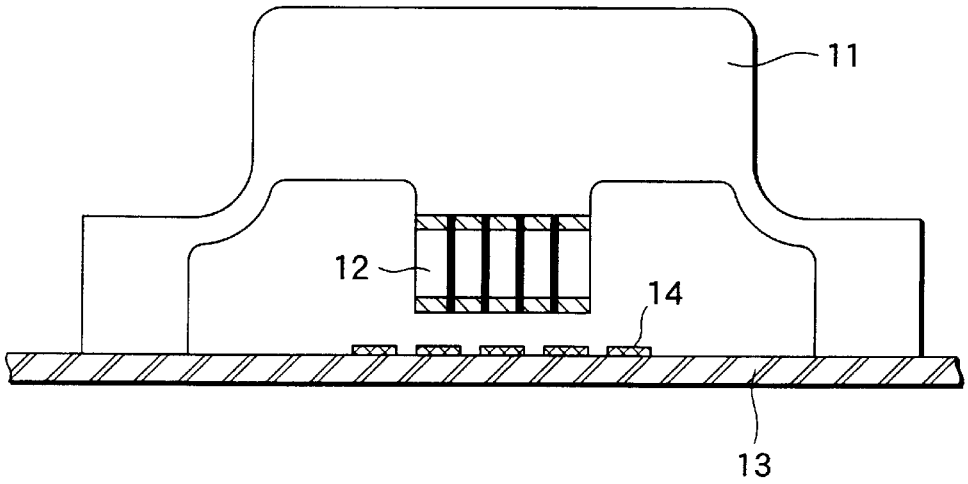
FIG. 1 is a sectional front view showing a structure of a button switch according to one embodiment of the invention.

FIG. 1 is a sectional front view showing a structure of a button switch according to an embodiment of the invention.

In FIG. 1, the button switch is composed of a key button 11, a key button contact portion 12 which includes a rubber piece having a plurality of thin metal wires embedded therein and electrically conductive films applied to its surfaces, the rubber piece being provided on a lower face of a pushing member of the button switch, and contact patterns 14 print-wired on a printed circuit board 13.

Figure 2:
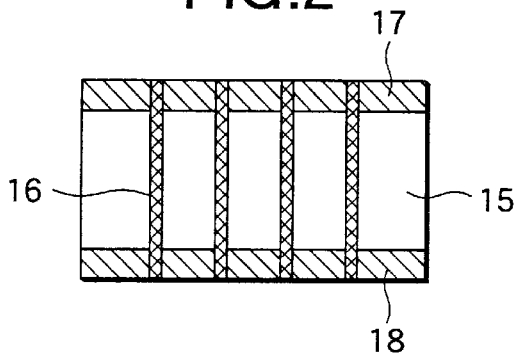
FIG. 2 is a sectional front view showing a structure of a contact member to be attached to a pushing member of the button switch according to the embodiment of the invention.

Usually, the key button 11 is formed of silicone rubber or the like. However, according to the invention, the key button is so constructed that a contact member includes a silicone rubber piece 15 provided with electrically conductive films 17, 18 on its upper and lower faces and having metal wires 16 embedded in the silicone rubber pieces so as to interconnect the electrically conductive films 17, 18, as shown in FIG. 2, and this contact member 12 is bonded to the pushing member of the key button.

Figure 3:
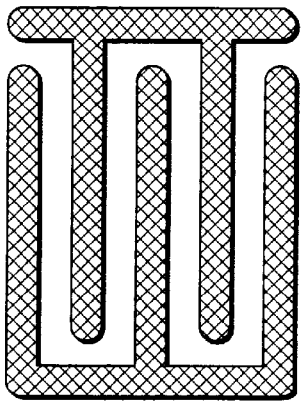
FIG. 3 is a view showing an example of conductive patterns which are printed and wired on a printed circuit board according to the embodiment of the invention.

FIG. 3 shows the electrically conductive patterns print-wired on the printed circuit board. The electrically conductive patterns are arranged in zigzag connection. This has been designed to facilitate the electrically conductive patterns to contact with either of the above-described metal wires.

Figure 4:
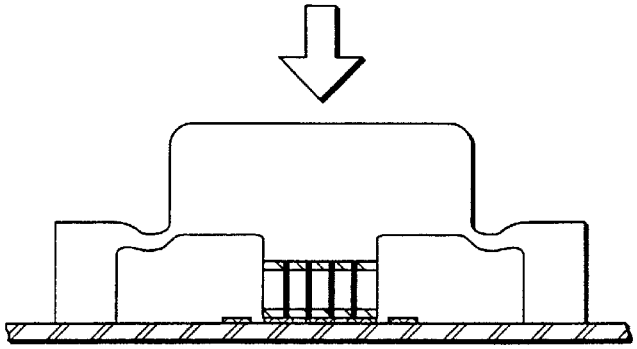
FIG. 4 is a sectional front view showing an example of operation of the button switch according to the embodiment of the invention.
Figure 5:
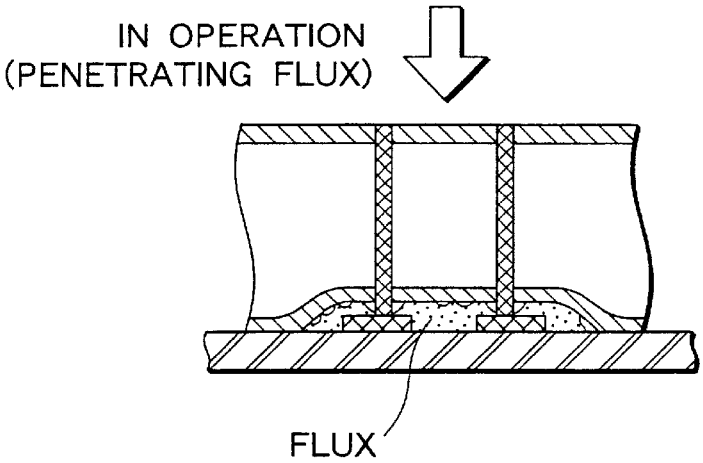
FIG. 5 is a sectional front view showing another example of the operation of the button switch according to the embodiment of the invention.
Figure 6:
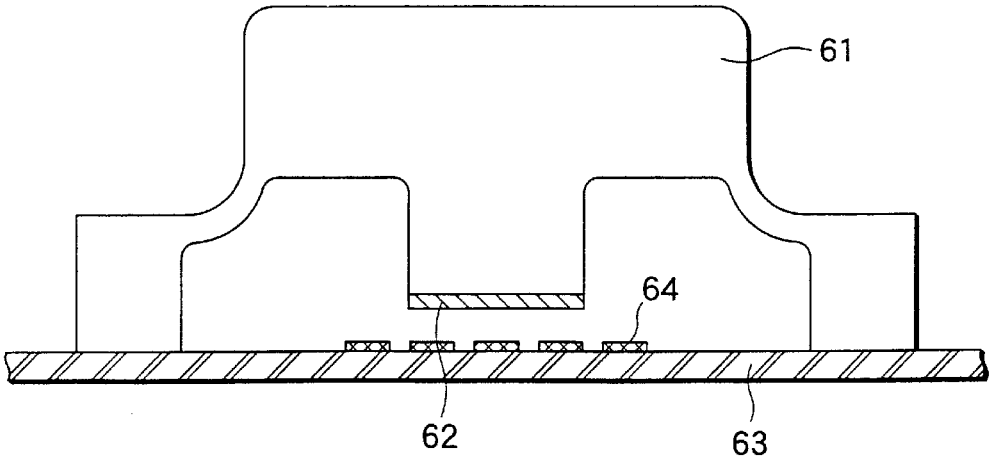
FIG.6 PRIOR ART
FIG. 6 is a sectional front view showing a structure of a conventional button switch.
Figure 7:
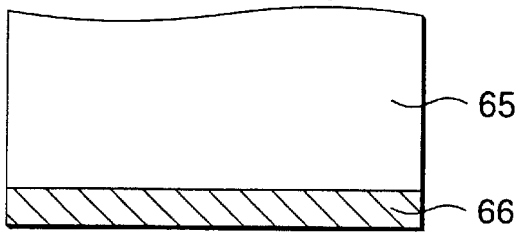
FIG.7 PRIOR ART
FIG. 7 is a sectional front view showing a structure of a contact member to be attached to a lower face of a pushing member of the conventional button switch.
Figure 8:
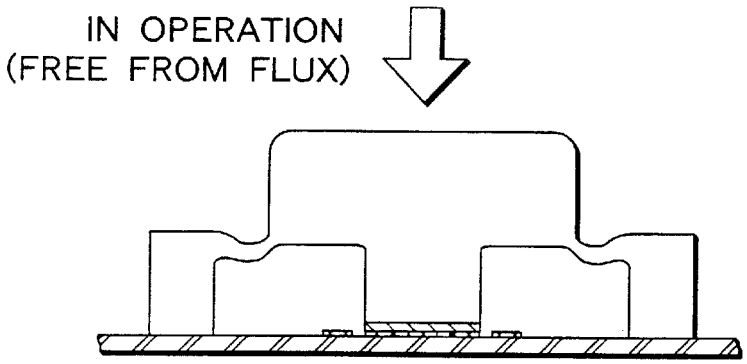
FIG.8 PRIOR ART
FIG. 8 is a sectional front view showing an example of operation of the conventional button switch.
Figure 9:
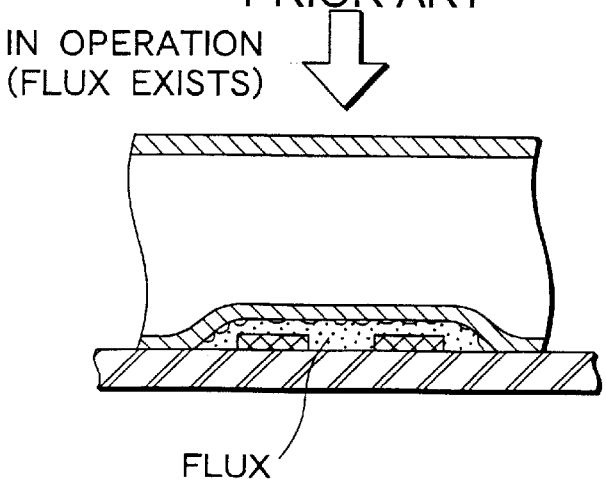
FIG.9 PRIOR ART
FIG. 9 is a sectional front view showing an example of the operation of the conventional button switch.

Operation of the button switch according to the invention will be described referring to FIGS. 4 and 5. In the button switch provided with the contact portion according to the invention, in case where the portion to be contacted such as the printed circuit board is free from foreign substances such as dust, oil, or flux of solder, etc., as shown in FIG. 4, normal switching operation can be performed by pushing the pushing member of the key button. Moreover, in case where the foreign substances such as dust, oil, or flux of solder, etc. have been adhered to the portion to be contacted such as the printed circuit board as shown in FIG. 5, the thin metal wires formed of chemical gold, for example, penetrate the aforesaid foreign substances and conduct the switching operation through the electrically conductive film formed on the upper face. Thus, faulty switching operation due to defective electrical conduction between the contacts can be avoided.

As described above, the button switch according to the invention is composed of the key button formed of silicone rubber, and the contact portion which includes the rubber piece of silicone having a plurality of the thin metal wires embedded therein and the electrically conductive films applied to both the surfaces. Therefore, in case where foreign substances such as dust, oil, or flux of solder, etc. have been adhered to the portion to be contacted such as the printed circuit board, the thin metal wires in the contact portion penetrate the foreign substances, whereby stable conduction of electricity can be obtained.

As described hereinabove, the button switch characterized by comprising the key button, and the key button contact portion which includes the rubber piece having a plurality of the thin metal wires embedded therein and the electrically conductive films applied to both the surfaces of the rubber piece, the rubber piece being provided on the lower face of the pushing member of the button switch. With this structure, the problem of defective switching operation can be solved and the stable conduction of electricity can be obtained.

Further, the button switch which comprises the contact member provided on the lower face of the pushing member of the button switch and adapted to be pushed to conduct switching operation of the contact patterns which are printed and wired on the printed circuit board, characterized in that the contact member includes the rubber piece, the electrically conductive films formed on the upper and lower faces of the rubber piece, and the metal wires embedded in the rubber piece so as to interconnect the electrically conductive films, the contact member being bonded to the pushing member. With this structure, the problem of defective switching operation can be solved and the stable conduction of electricity can be obtained.

Further, the electrically conductive films may be made of carbon. With this structure, the problem of defective switching operation can be solved employing the electrically conductive films made of carbon and the stable conduction of electricity can be obtained.

Still further, the metal wires may be gold wires. With this structure, the favorable electrical conductivity can be realized, the problem of defective switching operation can be solved, and the stable conduction of electricity can be obtained.

Still further, the rubber piece may be made of silicone rubber. With this structure, molding can be easily conducted, the problem of defective switching operation can be solved, and the stable conduction of electricity can be obtained.

What is claimed is:

1. A button switch comprising:

a key button; and a key button contact portion which includes a rubber piece having a plurality of thin metal wires embedded therein and electrically conductive films applied to both surfaces of said rubber piece, said rubber piece being provided on a lower face of a pushing member of said button switch.

2. A button switch as claimed in claim 1, wherein said electrically conductive films are made of carbon.

3. A button switch as claimed in claim 1, wherein said metal wires are gold wires.

4. A button switch as claimed in claim 1, wherein said rubber piece is made of silicone rubber.

5. A button switch comprising:

a pushing member;

a contact member provided on a lower face of said pushing member and adapted to be pushed to conduct switching operation of contact patterns which are print-wired on a printed circuit board, said contact member including a rubber piece, electrically conductive films formed on upper and lower faces of said rubber piece, and metal wires embedded in said rubber piece so as to interconnect said electrically conductive films, said contact member being bonded to said pushing member.

6. A button switch as claimed in claim 5, wherein said electrically conductive films are made of carbon.

7. A button switch as claimed in claim 5, wherein said metal wires are gold wires.

8. A button switch as claimed in claim 5, wherein said rubber piece is made of silicone rubber.

* * * * *